US010125404B2

(12) United States Patent
Matsubayashi et al.

(10) Patent No.: US 10,125,404 B2
(45) Date of Patent: Nov. 13, 2018

(54) METHOD FOR PRODUCING HIGH ELASTIC LIMIT NONMAGNETIC STEEL MATERIAL USING AN AUSTENITIC STAINLESS STEEL SHEET

(71) Applicant: NISSHIN STEEL CO., LTD., Tokyo (JP)

(72) Inventors: Hiroyasu Matsubayashi, Yamaguchi (JP); Sadayuki Nakamura, Yamaguchi (JP); Ryoji Hirota, Yamaguchi (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 205 days.

(21) Appl. No.: 14/765,623

(22) PCT Filed: Feb. 27, 2014

(86) PCT No.: PCT/JP2014/054807
§ 371 (c)(1),
(2) Date: Aug. 4, 2015

(87) PCT Pub. No.: WO2014/133058
PCT Pub. Date: Sep. 4, 2014

(65) Prior Publication Data

US 2015/0376729 A1 Dec. 31, 2015

(30) Foreign Application Priority Data

Feb. 28, 2013 (JP) ..... 2013-038502

(51) Int. Cl.
*C21D 8/02* (2006.01)
*C22C 38/00* (2006.01)
(Continued)

(52) U.S. Cl.
CPC ..... *C21D 8/0205* (2013.01); *C21D 6/004* (2013.01); *C21D 6/005* (2013.01); *C21D 6/02* (2013.01);
(Continued)

(58) Field of Classification Search
CPC ..... C21D 8/0205
See application file for complete search history.

(56) References Cited

U.S. PATENT DOCUMENTS 5,092,393 A * 3/1992 Suehiro et al. ..... 164/476
2011/0000589 A1* 1/2011 Hatano et al. ..... 148/610

FOREIGN PATENT DOCUMENTS

JP 61-213353 9/1986
JP 61-261463 11/1986
(Continued)

OTHER PUBLICATIONS

Machine translation of JP 2007302972, 2007.*

*Primary Examiner* — Edward Johnson
(74) *Attorney, Agent, or Firm* — Clark & Brody

(57) ABSTRACT

[Problem] To provide a raw material steel sheet for providing a high strength nonmagnetic austenitic stainless steel material that has a high elastic limit stress and excellent toughness.

[Solution to Problem] An austenitic stainless steel sheet containing 0.12% or less of C, from 0.30 to 3.00% of Si, from 2.0 to 9.0% of Mn, from 7.0 to 15.0% of Ni, from 11.0 to 20.0% of Cr, and 0.30% or less of N, and further containing at least one kind of 3.0% or less of Mo, 1.0% or less of V, 1.0% or less of Nb, 1.0% or less of Ti, and 0.010% or less of B, all in terms of percentage by mass, with the balance of Fe and unavoidable impurities, having a component composition having a Ni equivalent of 19.0 or more, having a value of $d^{-1/2}$ of 0.40 or more, wherein d (μm) represents an average austenitic crystal grain diameter, and
(Continued)

having a property that provides a magnetic permeability μ of 1.0100 or less after subjected to cold rolling with an equivalent strain of 0.50 or more.

10 Claims, 2 Drawing Sheets

(51) Int. Cl.

| | |
|---|---|
| ***C22C 38/58*** | (2006.01) |
| ***C22C 38/02*** | (2006.01) |
| ***C22C 38/34*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/40*** | (2006.01) |
| ***C21D 6/00*** | (2006.01) |
| ***C21D 6/02*** | (2006.01) |
| ***C21D 8/04*** | (2006.01) |
| *C21D 9/46* | (2006.01) |

(52) U.S. Cl.
CPC ..... *C21D 8/0236* (2013.01); *C21D 8/0436* (2013.01); *C22C 38/00* (2013.01); *C22C 38/001* (2013.01); *C22C 38/002* (2013.01); *C22C 38/02* (2013.01); *C22C 38/34* (2013.01); *C22C 38/40* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 8/0247* (2013.01); *C21D 8/0447* (2013.01); *C21D 9/46* (2013.01); *C21D 2211/001* (2013.01)

(56) References Cited

FOREIGN PATENT DOCUMENTS

| | | |
|---|---|---|
| JP | 5-098391 | 4/1993 |
| JP | 5-117813 | 5/1993 |
| JP | 6-004905 | 1/1994 |
| JP | 2007-302972 | 11/2007 |
| WO | 2002/088410 | 11/2002 |
| WO | 2011/062152 | 5/2011 |

* cited by examiner

[Fig.1]
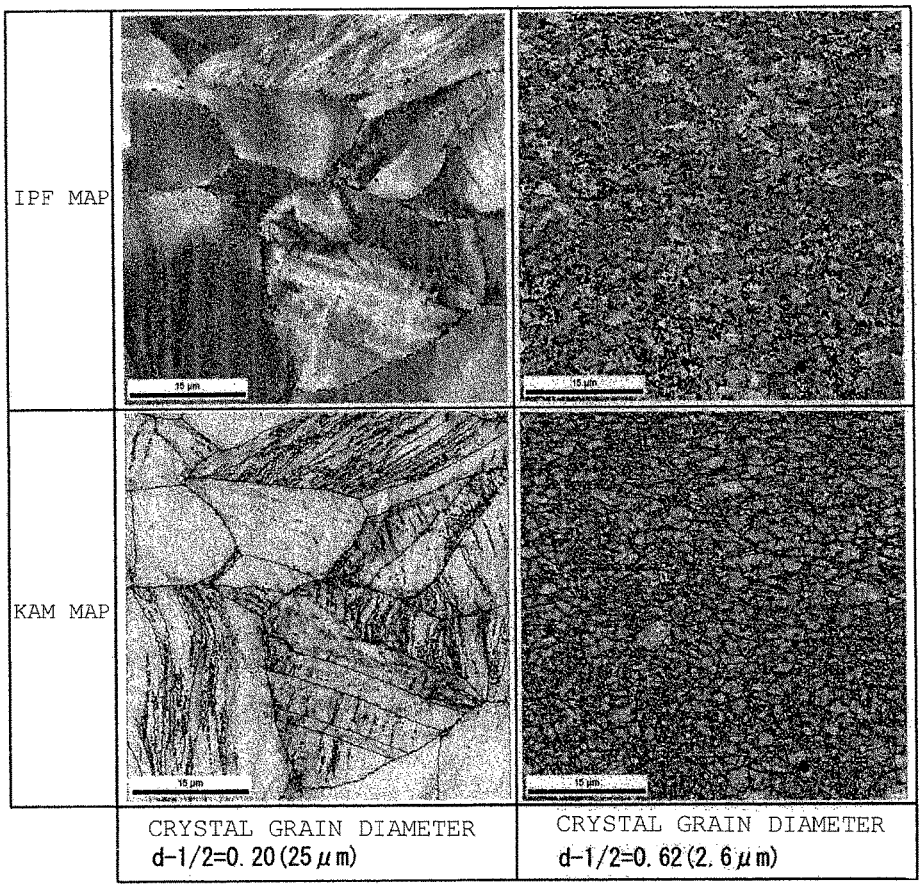
[Fig.2]
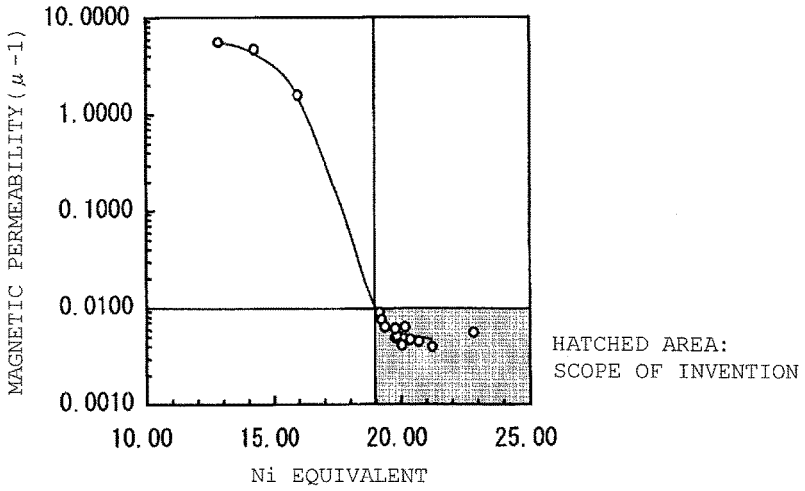

[Fig.3]
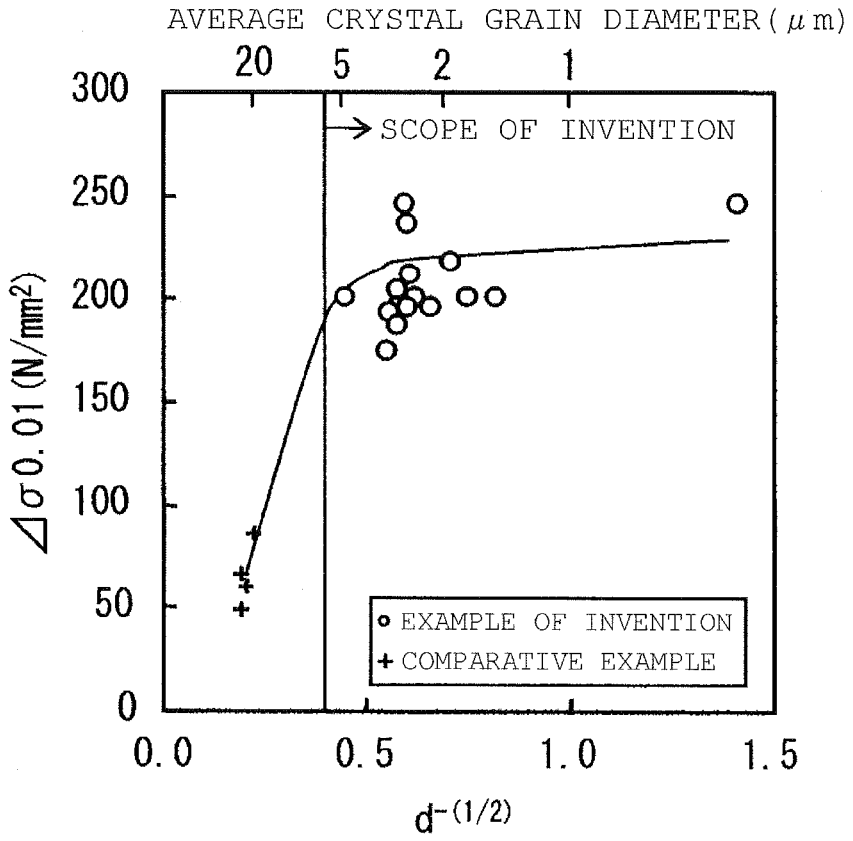

METHOD FOR PRODUCING HIGH ELASTIC LIMIT NONMAGNETIC STEEL MATERIAL USING AN AUSTENITIC STAINLESS STEEL SHEET

TECHNICAL FIELD

The present invention relates to an austenitic stainless steel sheet that is suitable for a part used in various types of equipment and devices functioning by utilizing magnetism and is capable of maintaining nonmagnetism even after working under severe condition, and to a method for producing a high elastic limit nonmagnetic stainless steel material that is excellent in toughness using the same as a raw material.

Background Art

An austenitic stainless steel represented by SUS304 has good corrosion resistance and exhibits a nonmagnetic austenitic structure in annealed condition, and thus the austenitic stainless steel is used as a nonmagnetic steel in various types of equipment and devices.

However, the austenitic stainless steel is necessarily used after it is subjected to work hardening through cold working since high strength is required therefor depending on purposes. SUS304 may be magnetized through induction of formation of martensite during cold working due to the metastable austenitic phase thereof, and thus may not be used as a nonmagnetic steel. SUS304N having a high N content may be used as a nonmagnetic steel for a purpose requiring high strength, but this steel species is still insufficient in the maintenance of nonmagnetism after cold working.

Accordingly, a SUS316 series steel species, which has a more stable austenitic phase, is generally used for a purpose requiring high strength and nonmagnetism. The steel species contains a large amount of Mo. However, Mo exhibits excellent effect for corrosion resistance but less contributes to the strength and the nonmagnetism. There are cases where even the SUS316 steel species is difficult to maintain the nonmagnetism in an application where high strength is important.

According to the rapid progress in the field of electronics in recent years, there are increasing needs of a steel sheet material that exhibits nonmagnetism and high elastic limit as a part used in various types of equipment and devices. The steel sheet material is generally imparted with high strength through an aging treatment after being formed into an intended part shape through punching or bending of a temper-rolled material. Therefore, in consideration of the productivity in mass production, such a material is demanded that is soft in the stage of the temper-rolled material to reduce the load of the die for punching and bending, and may be imparted with high hardness and high strength and also imparted with high elastic limit, through the aging treatment.

PTL 1 describes, as a nonmagnetic high-strength steel utilizing only work hardening, a nonmagnetic stainless steel that maintains nonmagnetism even after working under severe condition and is excellent in strength and corrosion resistance. PTL 2 describes a nonmagnetic stainless steel sheet that is excellent in spring characteristics. PTL 3 describes precipitation hardened high-strength nonmagnetic stainless steel.

CITATION LIST

Patent Literatures

PTL 1: JP-A-61-261463
PTL 2: JP-B-6-4905
PTL 3: JP-A-5-98391

SUMMARY OF INVENTION

Technical Problem

However, the steel sheet of PTL 1 may not necessarily provide sufficient aging hardening characteristics even after subjecting the steel sheet to ordinary temper rolling and an ordinary aging treatment. The steel sheet of PTL 2 achieves excellent spring characteristics by being subjected to an aging treatment after temper rolling, but in this technique, the temper rolling may provide large hardening effect, and the age hardening characteristics is still insufficient. The steel sheet of PTL 3 has poor workability due to the significant hardening in the temper rolling, and thus is not suitable for a part produced through punching and bending.

In a work hardening stainless steel, an austenitic phase that is regulated to have a crystal grain diameter of approximately 30 μm through a solution treatment is made to have high strength through working strain of cold rolling or the like. However, a part of the austenitic phase forms a texture through crystal rotation in a particular direction, and the crystal grains having reached the stable direction are difficult to undergo crystal rotation even by applying further deformation. Consequently, crystal grains that have less working strain introduced remain in the part of the austenitic phase. A texture containing a large number of austenitic crystal grains that have less working strain introduced is difficult to provide a high elastic limit stress through a subsequent aging treatment.

The alloy component design and the measure for enhancing strength utilizing introduction of high working strain and aging treatment in the ordinary techniques may be difficult to enhance the elastic limit stress to such a level that is sufficient as a spring material. The elastic limit stress may be simply enhanced to a certain extent by increasing the temper rolling reduction. However, the increase of the temper rolling reduction ratio may cause increase of the hardness, which impairs the workability.

The invention has been made for solving the problems, and an object thereof is to provide an austenitic stainless steel sheet that is capable of maintaining nonmagnetism even after working under severe condition and is capable of achieving a significantly enhanced elastic limit stress through an aging treatment. Another object thereof is to provide a method for producing a nonmagnetic steel material that has high strength, high elastic limit and high toughness, using the same as a raw material.

Solution to Problem

The objects may be achieved by an austenitic stainless steel sheet containing 0.12% or less, and more preferably from 0.02 to 0.09%, of C, from 0.30 to 3.00% or Si, from 2.0 to 9.0% of Mn, from 7.0 to 15.0%, and more preferably from 7.0 to 14.0%, of Ni, from 11.0 to 20.0%, and more preferably from 16.0 to 20.0%, of Cr, and 0.30% or less, and more preferably from 0.02 to 0.30%, of N, and further containing depending on necessity at least one kind of 3.0% or less of No, 1.0% or less of V, 1.0% or less of Nb, 1.0% or less of Ti, and 0.010% or less of B, all in terms of percentage by mass, with the balance of Fe and unavoidable impurities, having a component composition having a Ni equivalent defined by the following expression (1) or (3) of 19.0 or more, having a value of $d^{-1/2}$ ($\mu^{-1/2}$) of 0.40 or more, wherein d (μm) represents an average austenitic crystal grain diameter, and having a property that provides a magnetic permeability μ of 1.0100 or less after subjected to cold rolling with an equivalent strain of 0.50 or more:

$$\text{Ni equivalent}=\text{Ni}+0.6\text{Mn}+9.69(\text{C}+\text{N})+0.18\text{Cr}-0.11\text{Si}^2 \quad (1)$$

$$\text{Ni equivalent}=\text{Ni}+0.6\text{Mn}+9.69(\text{C}+\text{N})+0.18\text{Cr}-0.11\text{Si}^2+0.6\text{Mo}+2.3(\text{V}+\text{Nb}+\text{Ti}) \quad (3)$$

wherein the expression (3) is applied in the case where at least one kind of Mo, V, Nb, Ti and B is contained, and the expression (1) is applied to the other cases, and the element symbols each represent the content of the corresponding element in terms of percentage by mass.

The average austenitic crystal grain diameter d is an average value of circle equivalent diameters of austenitic crystal grains observed on a cross section perpendicular to the thickness direction (i.e., a polished plate surface, which may be hereinafter referred to as an ND plane).

The steel sheet of the invention is defined as a steel sheet before subjected to working, i.e., a forming steel sheet. The working referred herein includes cold working, such as cold rolling, wire drawing and bending. After the working, an aging treatment is performed to provide a high elastic steel material. The aging treatment may be performed not only in a continuous line, but also as a batch process after working into various parts.

The equivalent strain means an amount of strain under unidirectional stress that corresponds to the strain under multiaxial stress. The equivalent strain εe is shown by the following expression (5):

$$\varepsilon e=[(2/3)\times(\varepsilon_1^2+\varepsilon_2^2+\varepsilon_3^2)]^{1/2} \quad (5)$$

wherein the principal strain is represented by $\varepsilon_1$, $\varepsilon_2$ and $\varepsilon_3$.

The equivalent strain in the case of rolling is shown by the following expression (6):

$$\varepsilon e=(2/3^{1/2})\times\ln(h_0/h_1) \quad (6)$$

wherein $h_0$ represents the thickness (mm) before rolling, and $h_1$ represents the thickness (mm) after rolling.

The invention also relates to, as one embodiment of a method for producing a high elastic limit nonmagnetic stainless steel material, a production method containing subjecting the aforementioned stainless steel sheet to cold rolling at a rolling reduction ratio of 40% or more (for example, from 40 to 80%), and then subjecting the stainless steel sheet to an aging treatment at an aging temperature of from 300 to 600° C. under a condition that satisfies the following expression (4):

$$13{,}000<T(\log t+20)<16{,}500 \quad (4)$$

wherein T represents the aging temperature (K) in terms of absolute temperature, and t represents the aging time (h).

Assuming that the elastic limit stress in the rolling direction of the steel sheet before the aging treatment is represented by $\sigma_{0.01}[0]$ (N/mm$^2$), and the elastic limit stress in the rolling direction of the steel sheet after the aging treatment is represented by $\sigma_{0.01}[1]$ (N/mm$^2$), the increment of elastic limit stress $\Delta\sigma_{0.01}$ before and after the aging treatment is shown by the following expression (2):

$$\Delta\sigma_{0.01}=\sigma_{0.01}[1]-\sigma_{0.01}[0] \quad (2)$$

In the case of the austenitic stainless steel sheet of the invention, $\Delta\sigma_{0.01}$ is 150 N/mm$^2$ or more according to the aforementioned aging condition. The elastic limit stress $\sigma_{0.01}$ is a stress that forms a permanent strain of 0.01%, and may be obtained by an offset method from a stress-strain curve measured by a tensile test.

Advantageous Effects of Invention

According to the invention, an austenitic stainless steel sheet may be provided that is for a part used in various types of equipment and devices and is capable of maintaining nonmagnetism even after working under severe condition. The steel sheet may not necessarily contain expensive Mo and thus is superior in cost effectiveness to SUS316. The use of the steel sheet of the invention as a raw material may easily provide a high strength steel material that has a high elastic limit through an aging treatment, and the steel material is also excellent in toughness.

BRIEF DESCRIPTION OF DRAWINGS

FIG. 1 is a diagram showing IPF and KAM maps of ND planes measured by an electron back scatter diffraction (EBSD) of cold-rolled materials obtained by cold rolling at a rolling reduction ratio of 40% of annealed materials having different average crystal grain diameters.

FIG. 2 is a graphs showing relationship between a Ni equivalent and a magnetic permeability.

FIG. 3 is a graph showing relationship between $d^{-1/2}$ and $\Delta\sigma_{0.01}$.

DESCRIPTION OF EMBODIMENTS

The value of $d^{-1/2}$ (i.e., reciprocal of square root of d), wherein d (μm) represents the average austenitic crystal grain diameter, is hereinafter referred to as a crystal grain diameter $d^{-1/2}$. The present inventors have found that when the crystal grain diameter $d^{-1/2}$ is decreased to 0.40 or less, the austenitic crystal grains form a texture through rotation in a particular direction due to working deformation, but the elastic limit stress is enhanced through homogenization and refinement of the strain introduced.

Using the A1 steel in Table 1 described later, FIG. 1 shows the IPF and KAM maps of the ND planes measured by an electron back scatter diffraction (EBSD) of cold-rolled materials obtained by cold rolling under conditions of a rolling reduction ratio of 40% and a rolling temperature of 70° C. of an annealed material having a crystal grain diameter $d^{-1/2}$ of 0.20 (d=25 μm) and an annealed material having a crystal grain diameter $d^{-1/2}$ of 0.62 (d=2.6 μm). The KAM map shows the change of the local crystal orientation within the crystal grain, and is said to have proportional relation to the plastic deformation amount. In other words, the density of the color in the KAM map shows the extent of the strain amount. The material having a crystal grain diameter $d^{-1/2}$ of 0.62 (d=2.6 μm) has a larger strain amount accumulated in the crystal grain and a smaller difference in density of the color, and thus may be said to have a smaller fluctuation in strain than the material having a crystal grain diameter $d^{-1/2}$ of 0.20 (d=25 μm). A steel sheet having a texture having homogeneous and refined strain like this material may be considerably increased in the elastic limit through an aging treatment.

In the invention, the steel species having such requirements that martensite is not induced even being subjected to working under severe condition, and the nonmagnetism is maintained under the use condition, is employed. As an index for securing the requirements, the Ni equivalent in PTL 1 proposed by the inventors is effective.

Specifically, a magnetic permeability of 1.0100 or less in a magnetic field of 1 kOe (79.58 kA/m) is demanded for the application to a part used in various types of equipment and devices functioning by utilizing nonmagnetism. For such a magnetic permeability, the value of the Ni equivalent defined by the following expression (1) or (3) is necessarily 19.0 or more. The expression (3) is applied to a steel that contains at least one kind of Mo, V, Nb, Ti and B, and the expression (1) is applied to the other cases. In the expressions, the element symbols each represent the content of the corresponding element in terms of percentage by mass. In the case where the expression (3) is applied, the element symbol among Mo, V, Nb, Ti and B that is not added represents 0.

$$\text{Ni equivalent}=\text{Ni}+0.6\text{Mn}+9.69(\text{C}+\text{N})+0.18\text{Cr}-0.11\text{Si}^2 \quad (1)$$

$$\text{Ni equivalent}=\text{Ni}+0.6\text{Mn}+9.69(\text{C}+\text{N})+0.18\text{Cr}-0.11\text{Si}^2+0.6\text{Mo}+2.3(\text{V}+\text{Nb}+\text{Ti}) \quad (3)$$

FIG. 2 shows the influence of the Ni equivalent on the magnetic permeability in a magnetic field of 1 kOe (79.58 kA/m) of 80% cold rolled materials using the austenitic stainless steels shown in Table 1 described later. It is understood that nonmagnetism, that is, the magnetic permeability μ is 1.0100 or less (μ−1 of 0.0100 or less), is maintained in the case where the value of Ni equivalent is 19.0 or more.

For increasing the Ni equivalent, increase of the amounts of Ni and Mn is effective, but the work hardening capability of the steel may be lowered when the contents of these elements are too large, and thus the Ni equivalent is preferably in a range of from 19.0 to 21.0.

A steel that has the component composition defined above is formed into a cold rolled steel sheet through ordinary hot rolling and cold rolling, and then annealed to provide the steel sheet of the invention. In this case, it is important to perform the annealing under the condition that provides a crystal grain diameter $d^{-1/2}$ of 0.40 or more. For achieving the crystal grain diameter, the annealing temperature is preferably in a range of 700° C. or more and 1,000° C. or less, and more preferably in a range of 700° C. or more and 860° C. or less. In consideration of the cold rolling reduction ratio before the annealing, the annealing condition is selected which provides a crystal grain diameter $d^{-1/2}$ of 0.40 or more. The annealing condition may be obtained in advance by a preliminary experiment corresponding to the production line. The crystal grain diameter $d^{-1/2}$ is preferably 0.45 or more, and more preferably 0.50 or more. However, the austenitic crystal grains are necessarily constituted by recrystallized grains.

The steel sheet according to the invention having an austenitic crystal grain diameter $d^{-1/2}$ that is regulated as shown above may be formed into a shape of a part by being subjected to punching and then cold working, such as bending, and then may be imparted with high elasticity by the aging treatment. The nonmagnetism of the steel sheet may be maintained even though the steel sheet is subjected to the cold working under severe conditions resulting in an equivalent strain of 0.50 or more. In the case where an austenitic stainless steel sheet having a high elastic limit is provided as a raw material of a steel sheet, temper rolling may be performed to regulate the thickness and to enhance the strength, and then the steel sheet may be subj ected to the aging treatment. In this case, the annealing is performed before the temper rolling, and thus the annealing may be referred to as "annealing before temper rolling" in some cases. The nonmagnetism may be maintained even when the temper rolling is performed at a rolling reduction ratio providing an equivalent strain of 0.5 or more. The temper rolling reduction ratio may be more advantageously 40% or more (corresponding to an equivalent strain of 0.59 or more according to the expression (6)) for enhancing the strength. The upper limit of the temper rolling reduction may not be particularly determined, however, since excessive work hardening may result in difficulty in working of parts thereafter the temper rolling is preferably performed at a rolling reduction ratio of 80% or less (corresponding to an equivalent strain of 1.86 or less according to the expression (6)). The amount of cold working may be managed to a range that provides an equivalent strain of 1.5 or less.

The austenitic stainless steel sheet thus having a refined crystal grain diameter may provide a texture having a homogeneous distribution of working strain when subjected to temper rolling. Accordingly, the elastic limit stress $\sigma_{0.01}$ as an index of the elastic limit may be considerably increased by subjecting the steel sheet to the aging treatment thereafter. The condition for the aging treatment is preferably an aging temperature of from 300 to 600° C. and a condition that satisfies the following expression (4):

$$13{,}000<T(\log t+20)<16{,}500 \quad (4)$$

wherein T represents the aging temperature (K) in terms of absolute temperature, and t represents the aging time (h).

By subjecting the steel sheet according to the invention to the aging treatment under the aforementioned condition, the increment of elastic limit stress $\Delta\sigma_{0.01}$ before and after the aging treatment shown by the following expression (2) may be 150 N/mm$^2$ or more:

$$\Delta\sigma_{0.01}=\sigma_{0.01}[1]-\sigma_{0.01}[0] \quad (2)$$

wherein $\sigma_{0.01}[0]$ represents the elastic limit stress $\sigma_{0.01}$ (N/mm$^2$) in the rolling direction of the steel sheet before the aging treatment, and $\sigma_{0.01}[1]$ represents the elastic limit stress $\sigma_{0.01}$ (N/mm$^2$) in the rolling direction of the steel sheet after the aging treatment.

The content ranges of the alloy components will be described below. The percentages for the contents of the alloy components mean percentages by mass unless otherwise indicated.

C: 0.12% or Less

C is an element that strongly stabilizes the austenitic phase and is effective for enhancing the strength through working. It is more effective to ensure the C content of 0.02% or more. The increase of the C content may be a factor resulting in deterioration of corrosion resistance and the like, and thus the C content is restricted to 0.12% or less, and is more preferably 0.09% or less.

Si: 0.30 to 3.00%

Si is an element that is effective for enhancing the strength, and a Si content of 0.30 or more is ensured. However, the increase of the Si content may sharply increase the magnetic permeability after the cold working to fail to maintain the nonmagnetism. As a result of various investigations, the Si content is restricted to 3.00% or less.

Mn: 2.0 to 9.0%

Mn is an element that stabilizes austenite as similar to Ni, and suppresses the increase of the magnetic permeability due to cold working. Mn is also an element that enhances the solid solubility of N. For exhibiting these functions, a Mn content of 2.0% or more is ensured. A large amount of Mn contained may be a factor of deteriorating the low temperature toughness, and thus the Mn content is in a range of 9.0% or less.

Cr: 11.0 to 20.0%

Cr is a basic component of a stainless steel and is necessarily contained in an amount of 11.0% or more for providing corrosion resistance. Cr is more effectively contained in an amount of 16.0% or more for enhancing the corrosion resistance. When the Cr content is increased, the amount of δ ferrite formed may be increased to inhibit the maintenance of the nonmagnetism. The Cr content is restricted to 20.0% or less.

Ni: 7.0 to 15.0%

Ni is an element that is essential for stabilizing the austenitic phase. A Ni content of 7.0% is necessary for ensuring the nonmagnetism after cold working. A large amount of Ni contained may be a factor of lowering the strength enhancement effect of cold rolling, and thus the Ni content is restricted to 15.0% or less, and is more preferably 14.0% or less.

N: 0.30% or Less

N is an element that is effective for enhancing the strength and stabilizing the austenitic phase. It is more effective to ensure an N content of 0.02% or more. When the N content is increased, however, a casted slab in good condition may not be obtained in some cases. In the invention, the N content is restricted to 0.30% or less.

Mo: 3.0% or Less

Mo has a useful function including enhancement of the corrosion resistance and enhancement of the work hardening capability, and thus may be added depending on necessity. In the case where Mo is added, the content thereof is more effectively 0.2% or more. However, a large amount thereof added may increase the amount of δ ferrite formed, which is disadvantageous for maintaining the nonmagnetism. In the case where Mo is added, the content thereof is in a range of 3.0% or less, and more preferably 2.5% or less.

V: 1.0% or Less, Nb: 1.0% or Less, Ti: 1.0% or Less

V, Nb and Ti all have a function of enhancing the work hardening capability, and thus at least one kind thereof may be added depending on necessity. In the case where these elements are added, the contents thereof are more effectively 0.1% or more for V, 0.1% or more for Nb, and 0.1% or more for Ti. However, large amounts of the elements added may cause deterioration of the hot workability and formation of δ ferrite. In the case where at least one kind of these elements is added, the amounts thereof added each are necessarily 1.0% or less.

B: 0.010% or Less

B has a function of improving the hot workability, and thus may be added depending on necessity in a range of 0.010% or less. In the case where B is added, the amount thereof contained is more effectively 0.001% or more.

In addition to the aforementioned elements, Ca and REM (rare earth elements) used as a deoxidizing agent and a desulfurizing agent are allowed to be incorporated in an amount of 0.01% or less in total. Al used as a deoxidizing agent is allowed to be incorporated in an amount of 0.10% or less.

EXAMPLE

Steels having a chemical composition shown in Table 1 were produced with a vacuum melting furnace, subjected to hot rolling, then subjected to a solution treatment and cold rolling, subjected to intermediate annealing and cold rolling once or plural times, subjected to finishing annealing (corresponding to annealing before temper rolling), then subjected to temper rolling to make a thickness of 0.2 mm, and further subjected to an aging treatment. The condition for the aging treatment was 500° C.×1 h. In this case, the value of T(log t+20) in the expression (4) is 15,460. The finishing annealing temperature and the temper rolling reduction ratio are shown in Table 2. The equivalent strain according to the expression (6) is 0.59 for the case of a rolling reduction of 40%, 1.06 for the case of a rolling reduction of 60%, and 1.39 for the case of a rolling reduction of 70%.

The ND plane of the finishing annealed material was observed for the structure thereof, and the average crystal grain diameter d of the austenitic crystal grains was obtained as a circle equivalent diameter by image analysis. The average crystal grain diameter d and the crystal grain diameter $d^{-1/2}$ are shown in Table 2.

The plate surface of the temper rolled material was measured for Vickers hardness. A JIS 13B test piece in parallel to the rolling direction was subjected to a tensile test at a strain rate of $1.67\times10^{-3}$ ($s^{-1}$) to measure the elastic limit stress $\sigma_{0.01}$, the 0.2% proof stress $\sigma_{0.2}$, and the tensile strength $\sigma_B$. The temper rolled material was measured for the magnetic permeability in a magnetic field of 1 kOe (79.58 kA/m) with a vibrating sample magnetometer (produced by Riken Denshi Co., Ltd.). The measurement results are shown in Table 2.

The aging treated material was measured for hardness, σ0.01, σ0.2 and $\sigma_B$ in the same manner as the temper rolled material. The test piece after the tensile test was measured for the cross sectional contraction ratio (reduction) in the broken portion. The increment $\Delta\sigma_{0.01}$ of elastic limit stress $\sigma_{0.01}$ due to the aging treatment was obtained from the expression (2), and the effect of enhancement of the elastic limit was evaluated thereby. The values are shown in Table 2.

TABLE 1

| | Chemical composition (% by mass) | | | | | | | | | | | | | |
|---|---|---|---|---|---|---|---|---|---|---|---|---|---|---|
| Steel | C | Si | Mn | P | S | Ni | Cr | N | Mo | V | Nb | Ti | B | Ni equivalent |
| A1 | 0.052 | 0.62 | 2.80 | 0.023 | 0.006 | 12.90 | 18.20 | 0.090 | — | — | — | — | — | 19.19 |
| A2 | 0.073 | 0.60 | 3.53 | 0.021 | 0.004 | 12.70 | 17.60 | 0.120 | — | — | — | — | — | 19.82 |
| A3 | 0.024 | 1.70 | 4.24 | 0.020 | 0.007 | 12.88 | 19.88 | 0.190 | — | — | — | — | — | 20.76 |
| A4 | 0.050 | 2.81 | 3.90 | 0.018 | 0.006 | 12.46 | 18.70 | 0.154 | — | — | — | — | — | 19.27 |
| A5 | 0.060 | 1.70 | 3.31 | 0.025 | 0.010 | 12.44 | 18.00 | 0.132 | 2.00 | — | — | — | — | 20.41 |
| A6 | 0.052 | 1.64 | 3.10 | 0.030 | 0.009 | 12.42 | 17.98 | 0.141 | — | 0.34 | — | — | — | 19.87 |
| A7 | 0.060 | 1.50 | 3.40 | 0.025 | 0.009 | 12.40 | 18.20 | 0.140 | — | — | 0.35 | — | — | 20.21 |
| A8 | 0.064 | 1.63 | 3.00 | 0.028 | 0.011 | 12.60 | 18.12 | 0.189 | — | — | — | 0.45 | — | 20.86 |
| A9 | 0.090 | 0.50 | 8.80 | 0.025 | 0.011 | 7.50 | 20.00 | 0.290 | — | — | — | — | — | 20.03 |
| A10 | 0.120 | 0.59 | 3.50 | 0.021 | 0.009 | 13.98 | 17.00 | 0.100 | — | — | — | — | — | 21.23 |
| A11 | 0.119 | 0.78 | 6.60 | 0.019 | 0.013 | 14.90 | 11.80 | 0.080 | — | — | — | — | — | 22.85 |

TABLE 1-continued

| Steel | Chemical composition (% by mass) | | | | | | | | | | | | | Ni equivalent |
|---|---|---|---|---|---|---|---|---|---|---|---|---|---|---|
| | C | Si | Mn | P | S | Ni | Cr | N | Mo | V | Nb | Ti | B | |
| A12 | 0.050 | 0.59 | 3.10 | 0.022 | 0.007 | 13.00 | 17.98 | 0.088 | — | — | — | — | 0.0055 | 19.40 |
| A13 | 0.050 | 0.58 | 1.10 | 0.031 | 0.011 | 8.30 | 18.22 | 0.019 | — | — | — | — | — | 12.87 |
| A14 | 0.015 | 0.55 | 1.13 | 0.033 | 0.012 | 9.99 | 18.60 | 0.015 | — | — | — | — | — | 14.27 |
| A15 | 0.059 | 0.49 | 1.54 | 0.034 | 0.008 | 9.80 | 18.41 | 0.148 | — | — | — | — | — | 16.02 |

underlined value: outside the scope of the invention

TABLE 2

| Class | No. | Steel | Ni equivalent | Finishing annealed material | | | Temper rolled material | | | |
|---|---|---|---|---|---|---|---|---|---|---|
| | | | | Annealing temperature (° C.) | Average. crystal grain diameter d (μm) | Crystal grain diameter $d^{-1/2}$ | Temper rolling reduction (%) | Hardness (HV) | $\sigma_{0.01}$ (N/mm$^2$) | $\sigma_{0.2}$ (N/mm$^2$) |
| Invention | 1 | A1 | 19.19 | 800 | 0.5 | 1.41 | 40 | 421 | 804 | 1202 |
| | 2 | | | 850 | 2.8 | 0.60 | | 392 | 762 | 1142 |
| | 3 | | | 900 | 5.0 | 0.45 | | 373 | 700 | 1037 |
| | 4 | A2 | 19.82 | 850 | 3.0 | 0.58 | | 381 | 753 | 1132 |
| | 5 | A3 | 20.76 | | 3.2 | 0.56 | | 393 | 762 | 1144 |
| | 6 | A4 | 19.27 | | 2.8 | 0.60 | 40 | 380 | 754 | 1135 |
| | 7 | | | | | | 60 | 448 | 903 | 1355 |
| | 8 | | | | | | 70 | 459 | 918 | 1377 |
| | 9 | A5 | 20.41 | | 3.0 | 0.58 | 40 | 381 | 768 | 1154 |
| | 10 | A6 | 19.87 | | 2.7 | 0.61 | | 381 | 754 | 1133 |
| | 11 | A7 | 20.21 | | 3.3 | 0.55 | | 377 | 766 | 1150 |
| | 12 | A8 | 20.86 | | 2.3 | 0.66 | | 379 | 755 | 1130 |
| | 13 | A9 | 20.03 | | 3.0 | 0.58 | | 380 | 760 | 1151 |
| | 14 | A10 | 21.23 | | 1.8 | 0.75 | | 400 | 900 | 1366 |
| | 15 | A11 | 22.85 | | 2.0 | 0.71 | | 381 | 881 | 1278 |
| | 16 | A12 | 19.40 | | 1.5 | 0.82 | | 390 | 760 | 1140 |
| Comparison | 17 | A1 | 19.19 | 1050 | 25.0 | 0.20 | 40 | 360 | 740 | 1111 |
| | 18 | A2 | 19.82 | | 28.0 | 0.19 | | 374 | 731 | 1103 |
| | 19 | A3 | 20.76 | | 27.0 | 0.19 | | 371 | 724 | 1086 |
| | 20 | A4 | 19.27 | | 20.0 | 0.22 | 70 | 402 | 804 | 1206 |
| | 21 | A13 | 12.87 | 850 | 3.1 | 0.57 | 40 | 370 | 603 | 1000 |
| | 22 | A14 | 14.27 | | 2.8 | 0.60 | | 375 | 610 | 1021 |
| | 23 | A15 | 16.02 | | 3.3 | 0.55 | | 380 | 630 | 1050 |

| Class | No. | Temper rolled material | | Aging treated material | | | | | |
|---|---|---|---|---|---|---|---|---|---|
| | | $\sigma_B$ (N/mm$^2$) | Magnetic permeability μ | $\sigma_{0.01}$ (N/mm$^2$) | $\sigma_{0.2}$ (N/mm$^2$) | $\sigma_B$ (N/mm$^2$) | $\Delta\sigma_{0.01}$ (N/mm$^2$) | Reduction (%) | Hardness (HV) |
| Invention | 1 | 1262 | 1.0091 | 1050 | 1419 | 1470 | 246 | 31 | 470 |
| | 2 | 1202 | 1.0090 | 962 | 1381 | 1400 | 200 | 33 | 442 |
| | 3 | 1097 | 1.0087 | 900 | 1302 | 1350 | 200 | 36 | 420 |
| | 4 | 1192 | 1.0048 | 948 | 1348 | 1400 | 195 | 34 | 431 |
| | 5 | 1204 | 1.0043 | 955 | 1380 | 1400 | 193 | 35 | 443 |
| | 6 | 1195 | 1.0075 | 1000 | 1370 | 1380 | 246 | 34 | 431 |
| | 7 | 1420 | 1.0080 | 1098 | 1439 | 1460 | 195 | 33 | 501 |
| | 8 | 1440 | 1.0090 | 1154 | 1455 | 1465 | 236 | 30 | 509 |
| | 9 | 1214 | 1.0045 | 955 | 1387 | 1405 | 187 | 32 | 431 |
| | 10 | 1193 | 1.0050 | 966 | 1384 | 1403 | 212 | 31 | 433 |
| | 11 | 1210 | 1.0062 | 941 | 1383 | 1398 | 175 | 33 | 427 |
| | 12 | 1190 | 1.0058 | 950 | 1378 | 1399 | 195 | 32 | 434 |
| | 13 | 1211 | 1.0040 | 964 | 1382 | 1407 | 204 | 30 | 433 |
| | 14 | 1446 | 1.0038 | 1100 | 1412 | 1472 | 200 | 30 | 467 |
| | 15 | 1321 | 1.0054 | 1099 | 1398 | 1467 | 218 | 30 | 470 |
| | 16 | 1200 | 1.0061 | 960 | 1380 | 1399 | 200 | 34 | 471 |
| Comparison | 17 | 1170 | 1.0090 | 800 | 1198 | 1240 | 60 | 44 | 399 |
| | 18 | 1160 | 1.0048 | 780 | 1178 | 1198 | 49 | 42 | 397 |
| | 19 | 1146 | 1.0043 | 790 | 1193 | 1203 | 66 | 40 | 404 |
| | 20 | 1266 | 1.0075 | 890 | 1270 | 1289 | 86 | 10 | 410 |
| | 21 | 1060 | 6.4560 | 750 | 1204 | 1255 | 147 | 42 | 363 |
| | 22 | 1081 | 5.5611 | 760 | 1190 | 1212 | 150 | 45 | 370 |
| | 23 | 1110 | 2.5222 | 780 | 1190 | 1248 | 150 | 40 | 380 |

underlined value: outside the scope of the invention

FIG. 3 shows the relationship between the crystal grain diameter $d^{-1/2}$ and the increment of the elastic limit stress $\Delta\sigma_{0.01}$ before and after the aging treatment. It is understood that the specimens according to the invention, which have austenitic crystal grains that are refined to have $d^{-1/2}$ of 0.40 or more in the annealing before temper rolling, is significantly increased in the elastic limit stress in the aging treatment after temper rolling. As shown in Table 2, furthermore, according to the invention, the cross sectional contraction ratio (reduction) in the broken portion after the tensile test is 30% or more, which means excellent toughness after the aging treatment.

The invention claimed is:

1. A method for producing a high elastic limit nonmagnetic stainless steel material that is excellent in toughness, comprising:

subjecting an austenitic stainless steel sheet consisting of 0.02 to 0.09% of C, from 0.30 to 3.00% of Si, from 2.0 to 9.0% of Mn, from 7.0 to 14.0% of Ni, from 16.0 to 20.0% of Cr, and from 0.02 to 0.30% of N, all in terms of percentage by mass, with the balance of Fe and unavoidable impurities, having a component composition having a Ni equivalent defined by the following expression (1) of 19.0 or more to hot rolling, cold rolling, and annealing at a temperature of from 700° C. or more to 1000° C. or less to provide a value of $d^{-1/2}$ ($\mu m^{-1/2}$) of 0.40 or more, wherein d (μm) represents an average austenitic crystal grain diameter, then subjecting the stainless steel sheet to cold rolling at a rolling reduction ratio of 40% or more to provide a magnetic permeability μ of 1.0100 or less, and then subjecting the stainless steel sheet to an aging treatment at an aging temperature of from 300 to 600° C. under a condition that satisfies the following expression (4):

$$\text{Ni equivalent}=\text{Ni}+0.6\text{Mn}+9.69(\text{C}+\text{N})+0.18\text{Cr}-0.11\text{Si}^2 \quad (1)$$

$$13{,}000<T(\log t+20)<16{,}500 \quad (4)$$

wherein T represents the aging temperature in K in terms of absolute temperature, and t represents the aging time in h.

2. A method for producing a high elastic limit nonmagnetic stainless steel material that is excellent in toughness, comprising:

subjecting an austenitic stainless steel sheet consisting of 0.02 to 0.09% of C, from 0.30 to 3.00% of Si, from 2.0 to 9.0% of Mn, from 7.0 to 14.0% of Ni, from 16.0 to 20.0% of Cr, and from 0.02 to 0.30% of N, and further comprising at least one kind of 3.0% or less of Mo, 1.0% or less of Nb, 1.0% or less of Ti, and 0.010% or less of B, all in terms of percentage by mass, with the balance of Fe and unavoidable impurities, having a component composition having a Ni equivalent defined by the following expression (3) of 19.0 or more to hot rolling, cold rolling, and annealing at a temperature of from 700° C. or more to 1000° C. or less to provide a value of $d^{-1/2}$ ($\mu m^{-1/2}$) of 0.40 or more, wherein d (μm) represents an average austenitic crystal grain diameter, then subjecting the austenitic stainless steel sheet to cold rolling at a rolling reduction ratio of 40% or more to provide a magnetic permeability μ of 1.0100 or less, and then subjecting the austenitic stainless steel sheet to an aging treatment at an aging temperature of from 300 to 600° C. under a condition that satisfies the following expression (4):

$$\text{Ni equivalent}=\text{Ni}+0.6\text{Mn}+9.69(\text{C}+\text{N})+0.18\text{Cr}-0.11\text{Si}^2+0.6\text{Mo}+2.3(\text{V}+\text{Nb}+\text{Ti}) \quad (3)$$

$$13{,}000<T(\log t+20)<16{,}500 \quad (4)$$

wherein T represents the aging temperature in K in terms of absolute temperature, and t represents the aging time in h.

3. The method for producing a high elastic limit nonmagnetic stainless steel material according to claim 1, wherein the annealing temperature is from 700° C. or more to 900° C. or less.

4. The method for producing a high elastic limit nonmagnetic stainless steel material according to claim 2, wherein the annealing temperature is from 700° C. or more to 900° C. or less.

5. The method for producing a high elastic limit nonmagnetic stainless material according to claim 1, wherein the stainless steel has a property that provides an increment of elastic limit stress $\sigma_{0.01}$ before and after an aging treatment of 150 N/mm$^2$ or more.

6. The method for producing a high elastic limit nonmagnetic stainless material according to claim 2, wherein the stainless steel has a property that provides an increment of elastic limit stress $\sigma_{0.01}$ before and after an aging treatment of 150 N/mm$^2$ or more.

7. The method for producing a high elastic limit nonmagnetic stainless steel material according to claim 3, wherein the stainless steel has a property that provides an increment of elastic limit stress $\sigma_{0.01}$ before and after an aging treatment of 150 N/mm$^2$ or more.

8. The method for producing a high elastic limit nonmagnetic stainless steel material according to claim 4, wherein the stainless steel has a property that provides an increment of elastic limit stress $\sigma_{0.01}$ before and after an aging treatment of 150 N/mm$^2$ or more.

9. A method for producing a high elastic limit nonmagnetic stainless steel material that is excellent in toughness, comprising:

subjecting an austenitic stainless steel sheet consisting of from 0.02 to 0.09% of C, from 0.30 to 3.00% of Si, from 2.0 to 9.0% of Mn, from 7.0 to 14.0% of Ni, from 16.0 to 20.0% of Cr, and from 0.02 to 0.30% of N, and 1.0% or less of V, all in terms of percentage by mass, with the balance of Fe and unavoidable impurities, having a component composition having a Ni equivalent defined by the following expression (3) of 19.0 or more, to hot rolling, cold rolling, and annealing at an annealing temperature of from 700° C. or more to 900° C. or less to provide a value of $d^{-1/2}$ ($\mu m^{-1/2}$) of 0.40 or more, wherein d in μm represents an average austenitic crystal grain diameter, then subjecting the stainless steel sheet to cold rolling at a rolling reduction ratio of 40% or more to provide a magnetic permeability μ of 1.0100 or less, and then subjecting the stainless steel sheet to an aging treatment at an aging temperature of from 300 to 600° C. under a condition that satisfies the following expression (4):

$$\text{Ni equivalent}=\text{Ni}+0.6\text{Mn}+9.69(\text{C}+\text{N})+0.18\text{Cr}-0.11\text{Si}^2+0.6\text{Mo}+2.3(\text{V}+\text{Nb}+\text{Ti}) \quad (3)$$

$$13{,}000<T(\log t+20)<16{,}500 \quad (4)$$

wherein T represents the aging temperature in K in terms of absolute temperature, and t represents the aging time in h.

10. The method for producing a high elastic limit nonmagnetic stainless steel material according to claim 9, wherein the stainless steel has a property that provides an increment of elastic limit stress $\sigma_{0.01}$ before and after an aging treatment of 150 N/mm$^2$ or more.

* * * * *